United States Patent [19]

Sharma et al.

[11] Patent Number: 4,711,651

[45] Date of Patent: Dec. 8, 1987

[54] PROCESS FOR SEPARATION OF HYDROCARBON GASES

[75] Inventors: Shanmuk Sharma, Houston; Donnie K. Hill, Woodlands; Charles A. Durr, Houston, all of Tex.

[73] Assignee: The M. W. Kellogg Company, Houston, Tex.

[21] Appl. No.: 944,274

[22] Filed: Dec. 19, 1986

[51] Int. Cl.[4] ..... F25J 3/02

[52] U.S. Cl. ..... 62/34; 62/23; 62/24

[58] Field of Search ..... 62/23, 24, 27, 28, 32, 62/34, 36, 38, 39, 42, 44

[56] References Cited

U.S. PATENT DOCUMENTS

| | | | |
|---|---|---|---|
| 3,675,435 | 7/1972 | Jackson et al. | 62/39 X |
| 4,061,481 | 12/1977 | Campbell et al. | 62/29 |
| 4,167,402 | 9/1979 | Davis | 62/28 |
| 4,203,741 | 5/1980 | Bellinger et al. | 62/24 |
| 4,252,548 | 2/1981 | Markbreiter et al. | 62/23 X |
| 4,272,270 | 6/1981 | Higgins | 62/24 |
| 4,331,461 | 5/1982 | Karbosky et al. | 62/28 |
| 4,415,345 | 11/1983 | Swallow | 62/39 X |
| 4,451,275 | 5/1984 | Vines et al. | 62/39 X |
| 4,486,209 | 12/1984 | Fabbri et al. | 62/39 X |
| 4,507,133 | 3/1985 | Khan et al. | 62/29 |

*Primary Examiner*—William E. Wayner
*Assistant Examiner*—Steven E. Warner

[57] ABSTRACT

A process for separation of a high pressure gas stream such as refinery gas in which the starting gas mixture is cooled and separated into a first vapor portion and a first liquid portion which is expanded to an intermediate pressure. The first vapor portion is further cooled and separated into a second vapor portion which may be further processed for ultimate recovery of, for example, a methane-rich product gas and a second liquid portion which is expanded to essentially the same intermediate pressure and combined with the expanded first liquid portion. The resulting mixed intermediate pressure stream or a portion thereof is then employed as refrigerant.

9 Claims, 2 Drawing Figures

PROCESS FOR SEPARATION OF HYDROCARBON GASES

This invention relates to a process for cryogenic separation of high pressure, normally gaseous hydrocarbons. More particularly, the invention relates to a method for forming a cold process stream from which refrigeration may be recovered in greater amount than is possible by conventional, series expansions and cold recovery of the starting gas fractions. The process of the invention finds application in, for example, refinery gas separations, natural gas liquefaction, and natural gas liquids separation. The starting high pressure gas may also contain substantial amounts of carbon dioxide or nitrogen resulting from well injection of these gases for enhanced oil recovery operations. The process is particulary well suited for use in the separation of $C_3$–$C_4$ hydrocarbons for sale as liquefied petroleum gas (LPG).

According to the invention, the high pressure gas stream is cooled and separated into first vapor and first liquid portions. The first vapor portion is further cooled and separated into second vapor and second liquid portions. The first and second liquid portions are then separately expanded to a lower, intermediate pressure and combined. Refrigeration is then recovered from the resulting mixed intermediate pressure stream.

Figure 1:
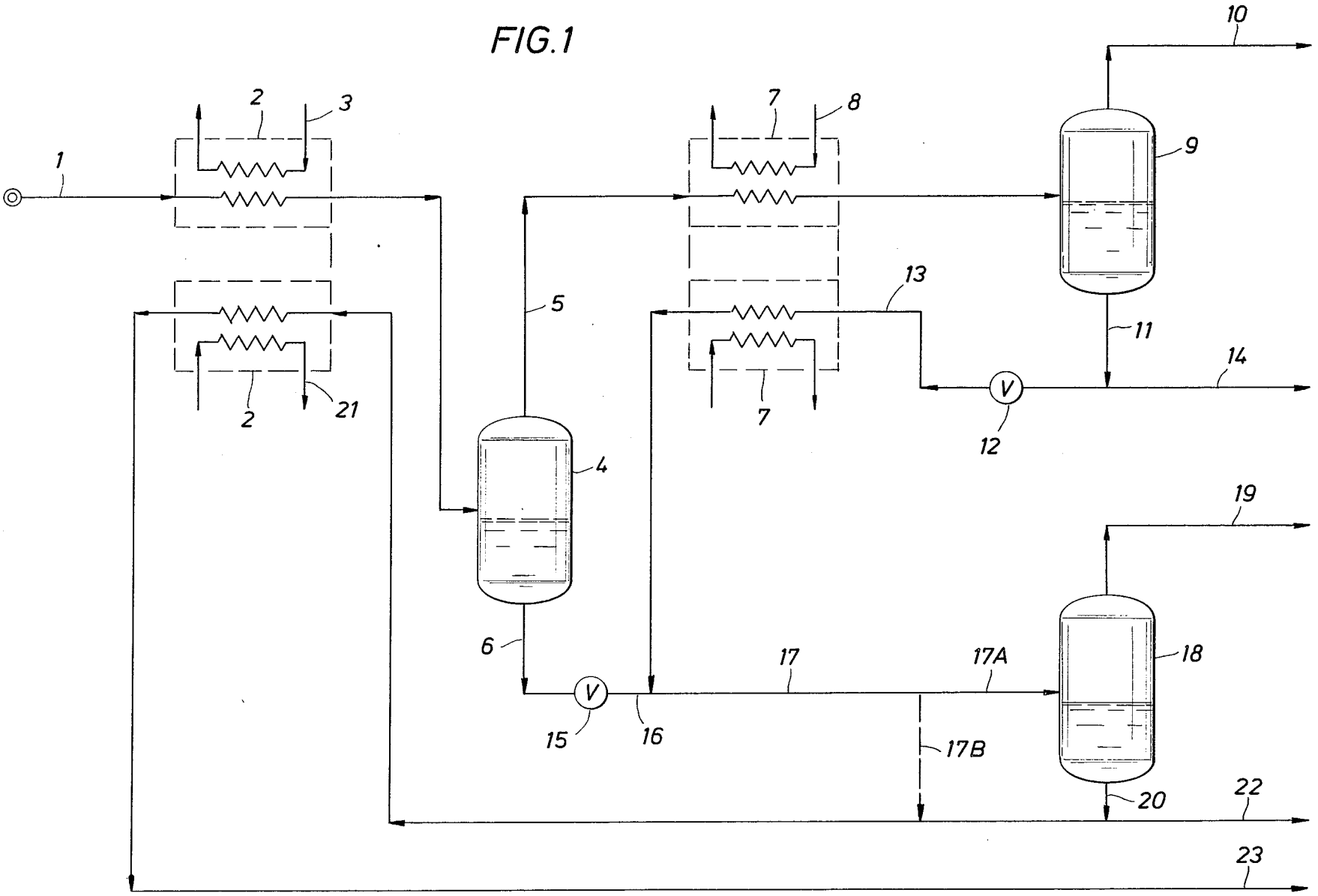
FIG. 1 is a flow diagram of the process of the invention.

Referring to FIG. 1, a high pressure gaseous stream containing mixed light hydrocarbons is introduced to the separation system through line 1. In this embodiment, the high pressure stream contains principally methane with lesser amounts of $C_2$ through $C_6$ hydrocarbons, hydrogen, and some nitrogen.

The feed mixture will be at sufficiently high pressure to provide at least two stages of expansion from which refrigeration can be derived typically within the range from 5 to 55 kg/cm$^2$a. Typically, the intermediate pressure range will be 3 to 40 kg/cm$^2$a. To the extent that the starting mixture contains undesired water, hydrogen sulfide, or carbon dioxide, these constituents are removed by known methods upstream of the process of the invention. When the hydrocarbon gases are associated with nitrogen or carbon dioxide from enhanced oil recovery operations in amounts between 10 and 90 volume percent of the starting high pressure gaseous stream, these constituents remain with the lighter gases in the process and usually will be the principal component of the first vapor stream.

The high pressure gaseous stream is cooled in exchanger 2 by any available cold stream as indicated by stream 3 but, preferably, is cooled with refrigeration developed in the separation system. The resulting cooled high pressure stream is introduced at substantially the same elevated pressure to a first separation zone shown by flash drum 4 from which a first vapor stream 5 and a first liquid stream 6 are recovered.

The first vapor stream is further cooled in exchanger 7 by any available cold stream as indicated by stream 8 but, preferably, is cooled with refrigeration further developed in the separation system and delivered to exchanger 7 by line 13. The resulting cooled stream is then introduced at substantially the same elevated pressure to a second separation zone shown by flash drum 9 from which a second vapor stream 10 and a second liquid stream 11 are recovered. In refinery gas applications, the second vapor stream will contain most of the starting methane, substantially all of the starting hydrogen and nitrogen, but lesser amounts of $C_2$–$C_3$ hydrocarbons whereas the second liquid stream will contain principally $C_2$–$C_3$ hydrocarbons. At least a major portion of the second liquid stream 11 is expanded across valve 12 to form second intermediate pressure stream 13. The remaining portion, if any, in stream 11 is sent to downstream separation steps via line 14.

First liquid stream 6 recovered from flash drum 4 is expanded across valve 15 to form first intermediate pressure stream 16 which is combined with the second intermediate stream 13 to form a mixed intermediate stream 17. Preferably, refrigeration is recovered from stream 13 prior to combination with stream 16. In refinery gas applications, mixed intermediate pressure stream 17 will contain principally $C_2$ hydrocarbons with lesser amounts of $C_3$–$C_5$ hydrocarbons, some methane, and substantially no hydrogen or nitrogen. A further cut of $C_1$ from $C_2$+ hydrocarbons may be obtained by introducing mixed intermediate pressure stream 17 through line 17A to a third separation zone shown by flash drum 18 from which third vapor stream 19 and third liquid stream 20 are recovered. If further separation of this stream is not desired, the third zone is not used and the mixed intermediate pressure stream flows through line 17B.

By virtue of expansion across valves 12 and 15, the mixed intermediate pressure stream constitutes a significant source of refrigeration since it is at a temperature typically within the range from −1° C. to −85° C. and contains most of the $C_3$+ constituents of the starting hydrocarbon mixture. This refrigeration may be recovered and used in other steps of the overall flowsheet as indicated by line 21 in exchanger 2 but is preferably recovered by cooling the entering hydrocarbon mixture in line 1.

Figure 2:
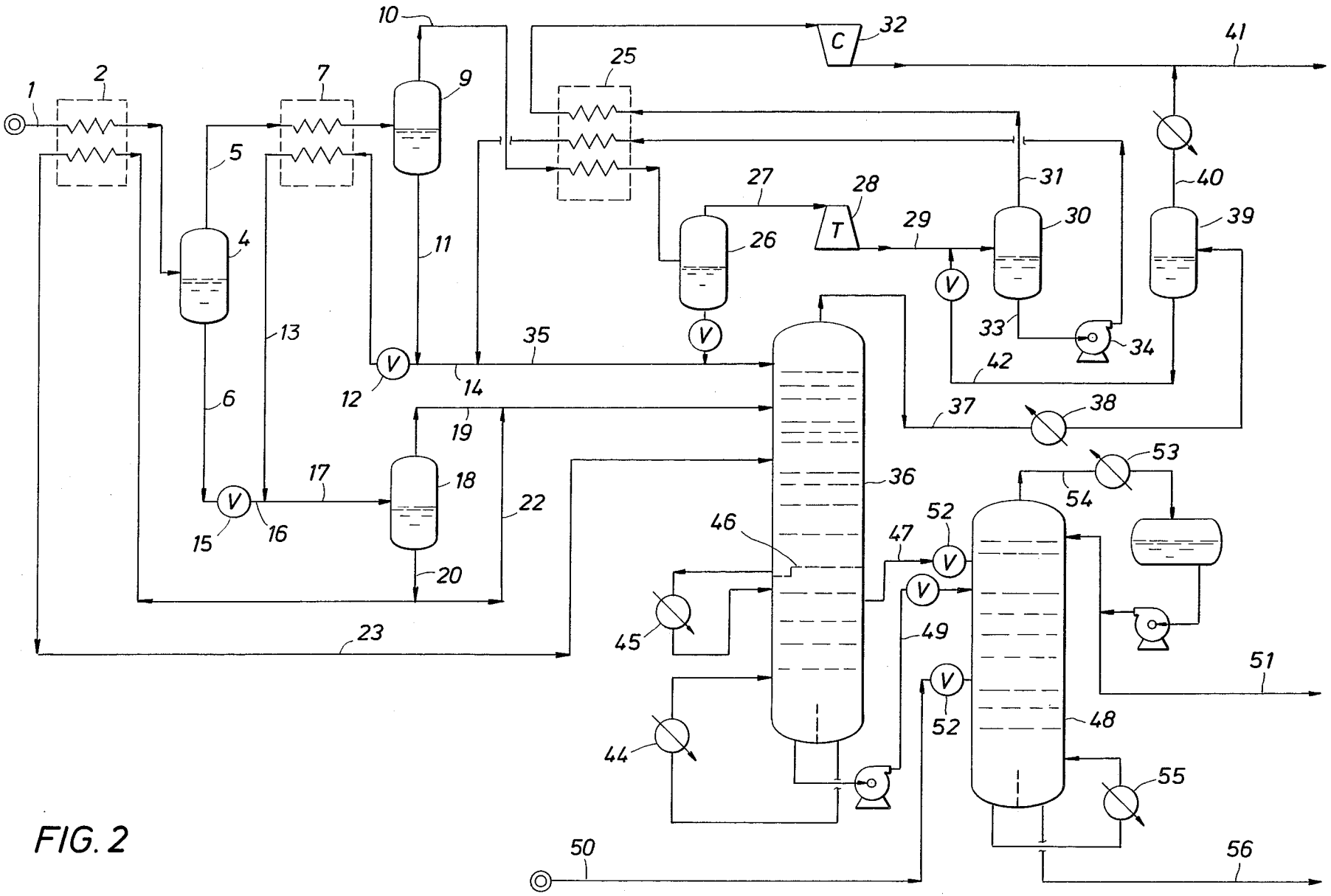
FIG. 2 is an overall flow diagram of a process for separation of refinery gases for the principal object of LPG production and illustrates use of the invention in the upstream section of a refinery gas flow scheme.

As will be apparent from FIG. 2, the process of the invention is suitable for use in prefractionation of gas mixtures upstream of a fractional distillation system. Since the mixed intermediate pressure stream is available at two temperatures, i.e.—before and after recovery of refrigeration, additional prefractionation may be obtained by taking a colder portion through line 22 to an appropriate feedpoint of a downstream fractionation column while taking a warmer portion through line 23 to a lower feedpoint on the same downstream fractionation column.

The first, second, and third separation zones may be fractionation columns or portions thereof but are preferably single equilibrium separation zones exemplified by the flash drums described.

Typical operating conditions for the separation zones are:

| | Refinery Gas | Gas Liquids from Enhanced Oil Recovery with: $N_2$ | $CO_2$ |
|---|---|---|---|
| First Separation Zone | | | |
| Temperature (°C.) | −30 | −30 | −5 |
| Pressure (kg/cm$^2$a) | 15 | 40 | 30 |
| Second Separation Zone | | | |
| Temperature (°C.) | −55 | −55 | −25 |
| Pressure (kg/cm$^2$a) | 15 | 40 | 30 |

-continued

| | Refinery Gas | Gas Liquids from Enhanced Oil Recovery with: $N_2$ | $CO_2$ |
|---|---|---|---|
| Third Separation Zone | | | |
| Temperature (°C.) | −35 | −35 | −25 |
| Pressure (kg/cm²a) | 7 | 20 | 20 |

Referring now to FIG. 2 in which reference numerals are common with those in FIG. 1, a dried refinery gas stream substantially free of acid gas and $C_5+$ hydrocarbon components is introduced to the LPG separation system through line 1 at a pressure of 12 kg/cm²a. A typical stream composition is:

| | |
|---|---|
| Hydrogen | 9.2 mole percent |
| Nitrogen | 4.7 mole percent |
| $CH_4$ | 45.6 mole percent |
| $C_2H_4/C_2H_6$ | 28.4 mole percent |
| $C_3H_6/C_3H_8$ | 9.2 mole percent |
| $C_4H_8/C_4H_{10}$ | 2.6 mole percent |
| $C_5+$ | 0.3 mole percent |

This high pressure gas stream is cooled to −29° C. in exchanger 2 and flashed in drum separator 4. The vapor stream from separator 4 is further cooled to −55° C. in exchanger 7 and flashed in separator 9 from which the vapor portion is further cooled in exchanger 25° to −68° C. and flashed in separator 26 to yield a high pressure gas stream containing substantially all of the starting hydrogen and nitrogen, most of the methane, and about half of the $C_2$ components. This methane-rich stream is expanded across turbine 28, which extracts shaft work for compressor 32, and discharged at a temperature of −92° C. and pressure of 4 kg/cm²a to separator 30 where more of $C_2+$ components are separated as liquid. Refrigeration is recovered from the remaining methane-rich vapor in line 31 through a series of heat exchangers of which only exchanger 25 is shown and the resulting product gas is recompressed in compressor 32 to delivery pressure of 5 kg/cm²a in line 41.

The cold liquid stream 11 from separator 9 is expanded across valve 12 to a pressure of 7 kg/cm²a and provides refrigeration to vapor stream 5 entering exchanger 7. If desired, a portion of this stream may be expanded and taken forward in the process through line 14. Following refrigeration recovery, stream 13 is combined with cold stream 16 which results from expansion of separator 4 liquid and the resulting mixed intermediate pressure stream in line 17 is flashed in separator 18. The resulting liquid stream 20 which contains most of the $C_3+$ components of the starting gas in line 1 provides an enhanced source of refrigeration for the starting gas in exchanger 2 from which it is recovered as stream 23 at a temperature of −4° C. and introduced to de-ethanizer column 36.

The balance of stream 20 not needed in exchanger 2 is sent forward through line 22 and combined with vapor leaving separator 18 prior to introduction to column 36. Since stream 23 is warmer than combined streams 19 and 22, it is evident that stream 17 has been prefractionated into discrete portions prior to introduction to column 36 and thereby reduces separation requirements of the column.

Liquid from separator 26 is expanded across a valve, combined with flow in line 35 and introduced to an upper feed point of column 36. Since this stream is substantially colder than the two lower feeds, it represents an additional prefractionation of the starting gas. De-ethanizer column 36 overhead gas is principally $C_2$ components of the starting gas and is cooled in heat exchanger 38 to −54° C. and flashed in separator 39. Refrigeration is recovered from the resulting vapor stream 40 which is principally $C_2$ hydrocarbons and methane and the resulting warmer stream then combined with product gas discharged from compressor 32.

Since separator 39 is over 1 kg/cm² higher in pressure than separator 30, additional refrigeration is recovered by expanding liquid stream 42 into separator 30 which operates at the discharge pressure of turbine 28. The resulting very cold liquid 33 from separator 30 is increased to column pressure by pump 34 and refrigeration is recovered from the stream in exchanger 25. The resulting relatively warmer stream 35 is then combined with underflow from separator 26 and introduced to the de-ethanizer column.

The function of de-ethanizer column 36 is of course to remove $C_2$ and lighter feed streams from what is to be the desired LPG product removed from the column bottoms. Since the bottoms stream 49 also contains a minor amount of $C_5+$ material, it is further fractionated in debutanizer column 48 which has the principal function of separating $C_3/C_4$ components from a previously separated light gasoline stream introduced through line 50. In customary operation, column 36 bottoms are reboiled through exchanger 44 and column 48 bottoms are reboiled through exchanger 55 while column 48 overhead is cooled in heat exchanger 35 and refluxed through exchanger 53. The final separations carried out in column 48 result in recovery of an LPG product stream through line 51 and a light gasoline stream through line 56.

With this two column operation, it is apparent that bottom liquids from column 36 removed through line 49 must again be vaporized in column 48 by reboiler 55. In order to reduce this vaporization requirement, a lighter liquid side stream is removed from an intermediate tray 46 in column 36, vaporized in side reboiler 45 and discharged back into the column below the intermediate tray and a vapor side stream is withdrawn from another intermediate point of column 36 and introduced to column 48 through line 47. Needless to say, reboiler 45 displaces duty that would otherwise be required in reboiler 44.

We claim:

1. A process for separation of a high pressure gaseous stream containing mixed light hydrocarbons which comprises:

(a) cooling the high pressure gaseous stream and introducing the resulting cooled high pressure stream to a first, single equilibrium, separation zone;

(b) recovering a first vapor stream and a separate first liquid stream from the first, single equilibrium, separation zone;

(c) expanding the first liquid stream to form a first intermediate pressure stream;

(d) cooling the first vapor stream and introducing the resulting cooled stream to a second, single equilibrium, separation zone operated at substantially the same pressure as the first, single equilibrium, separation zone;

(e) recovering a second liquid stream from the second, single equilibrium, separation zone;

(f) expanding at least a major portion of the second liquid stream to form a second intermediate pressure stream;

(g) combining the first and second intermediate pressure streams to form a mixed intermediate pressure stream; and (h) recovering refrigeration from at least a portion of the mixed intermediate pressure stream.

2. The process of claim 1 wherein refrigeration recovered from the mixed intermediate pressure stream is employed for cooling the high pressure gaseous stream.

3. The process of claim 1 wherein the first vapor stream contains hydrogen and methane.

4. The process of claim 1 wherein refrigeration is recovered from the second intermediate pressure stream prior to combination with the first intermediate pressure stream.

5. The process of claim 4 wherein refrigeration recovered from the second intermediate pressure stream is employed for cooling the first vapor stream.

6. The process of either claim 1 or claim 4 wherein the mixed intermediate pressure stream is introduced to a third, single equilibrium, separation zone and a third vapor stream containing methane is recovered from the third, single equilibrium, separation zone.

7. The process of either claim 1 or claim 4 wherein the high pressure gaseous stream is at a pressure between 5 and 55 $kg/cm^2a$ and the intermediate pressure stream is at a pressure between 3 and 40 $kg/cm^2a$.

8. The process of either claim 1 or claim 4 wherein the high pressure gaseous stream contains between 10 and 90 volume percent nitrogen and the first vapor stream contains principally nitrogen.

9. The process of either claim 1 or claim 4 wherein the high pressure gaseous stream contains between 10 and 90 volume percent carbon dioxide and the first vapor stream contains principally carbon dioxide.

* * * * *